US011181121B2

(12) United States Patent
Kushnarev et al.

(10) Patent No.: US 11,181,121 B2
(45) Date of Patent: Nov. 23, 2021

(54) PIPELINE PUMP

(71) Applicant: Obshchestvo s ogranichennoy otvetstvennostyu "Neftekamskyi mashinostroitel'nyi zavod", Neftekamsk (RU)

(72) Inventors: Vladimir Ivanovich Kushnarev, Moscow (RU); Ivan Vladimirovich Kushnarev, Moscow (RU); Yurii Sergeevich Oboznyi, Sumi (UA)

(73) Assignee: OOO Neftekamskyi Mashinostroitel'nyi Zavod, Neftekamsk (RU)

( * ) Notice: Subject to any disclaimer, the term of this patent is extended or adjusted under 35 U.S.C. 154(b) by 400 days.

(21) Appl. No.: 16/337,187

(22) PCT Filed: Sep. 26, 2017

(86) PCT No.: PCT/RU2017/000710
§ 371 (c)(1),
(2) Date: Dec. 23, 2019

(87) PCT Pub. No.: WO2018/063031
PCT Pub. Date: Apr. 5, 2018

(65) Prior Publication Data

US 2020/0208648 A1 Jul. 2, 2020

(30) Foreign Application Priority Data

Sep. 27, 2016 (RU) ..... RU2016138297

(51) Int. Cl.
*F04D 29/40* (2006.01)
*F04D 29/043* (2006.01)
(Continued)

(52) U.S. Cl.
CPC ..... *F04D 29/406* (2013.01); *F04D 29/043* (2013.01); *F04D 29/046* (2013.01); *F04D 1/006* (2013.01)

(58) Field of Classification Search
CPC .... F04D 29/406; F04D 29/426; F04D 29/628; F04D 1/00; F04D 1/006
See application file for complete search history.

(56) References Cited

U.S. PATENT DOCUMENTS 6,203,297 B1 * 3/2001 Patel ..... F04C 18/126 418/15
9,644,638 B2 * 5/2017 Kushnarev ..... F04D 1/006
(Continued)

FOREIGN PATENT DOCUMENTS

DE 102007009781 A1 8/2008
GB 890930 A 3/1962
(Continued)

OTHER PUBLICATIONS

PCT/RU2017/000710 International Preliminary Report on Patentability Chapter I, dated Apr. 2, 2019.

*Primary Examiner* — Richard A Edgar
*Assistant Examiner* — Jackson N Gillenwaters
(74) *Attorney, Agent, or Firm* — IRL Legal Services, LLC; Ilya R. Lapshin

(57) ABSTRACT

The invention relates to centrifugal pumps and can be used for pumping oil and other fluids along pipelines. A pump comprises a set of strength elements in the form of reinforcing ribs connecting a pump housing to the surfaces of supporting feet of the pump. The fastening surfaces of the feet are situated along the central axis of the inlet and outlet lines. The feet are connected by the reinforcing ribs to the inlet and outlet lines and to bearing assembly housings and connect the housings to one another. The feet themselves are connected to each other in pairs by ribs which pass below the
(Continued)

Figure 1:
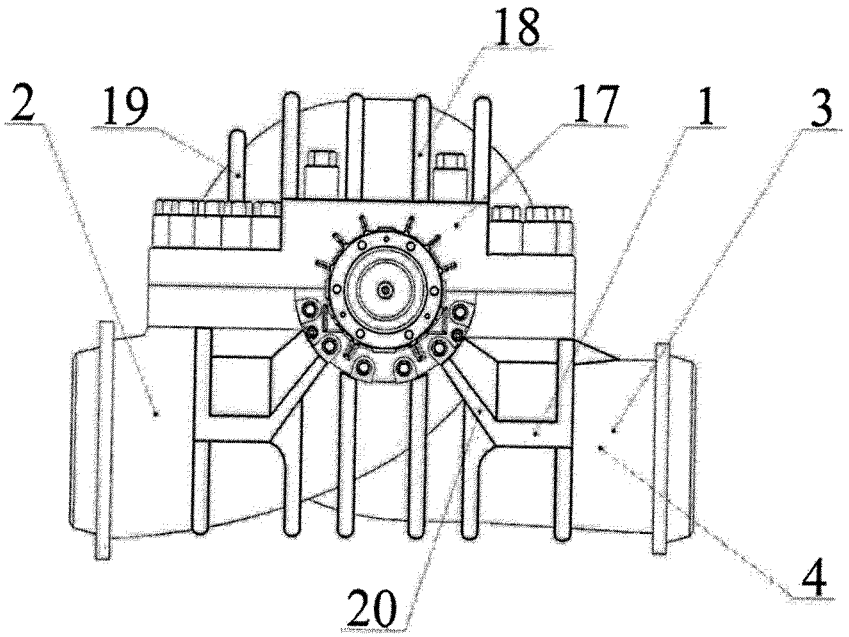

base of the pump housing. The base and the cover of the housing are configured with interior chambers which form an inlet and an outlet. All of the ribs are integral with the cover or the base. The invention is directed toward increasing the reliability and working life of the pump by reducing vibration loads and increasing leak tightness while at the same time minimizing the material requirements of the pump structure.

2 Claims, 5 Drawing Sheets

(51) Int. Cl.
*F04D 29/046* (2006.01)
*F04D 1/00* (2006.01)

(56) References Cited

U.S. PATENT DOCUMENTS

| | | | | |
|---|---|---|---|---|
| 10,788,046 | B2 * | 9/2020 | Colson | F04D 29/624 |
| 2016/0245291 | A1 * | 8/2016 | Carnes | F04D 9/06 |
| 2021/0115940 | A1 * | 4/2021 | Ogawa | F04D 29/4273 |

FOREIGN PATENT DOCUMENTS

| | | | |
|---|---|---|---|
| RU | 2059890 | C1 | 5/1996 |
| RU | 73704 | U1 | 5/2008 |
| RU | 2484304 | C1 | 6/2013 |
| RU | 2530953 | C2 | 10/2014 |

* cited by examiner

PIPELINE PUMP

The invention relates to horizontal centrifugal pipeline pumps and can be used for oil pumping along main pipelines, as well as in other industries for pumping various liquids.

The patent RU 2484304 C1 describes an electric pumping unit with a main horizontal centrifugal pump (hereinafter, a pump) where the fastening surfaces of the "feet" are raised to the level of the common central axis of the inlet and outlet pump adapters, see FIG. 1, FIG. 2, FIG. 3 and their description in the text. FIG. 3 shows the ribs extending along the cover of the pump, some of which are connected to the bulges on the flange of the cover, and the others are connected to the flange itself, as well as the ribs connecting the rotor bearing units housing to the feet of the pump; however, these ribs are not designated by reference numbers and are not mentioned in the specification, including the technical result to which they can provide. A disadvantage of the pump used in this unit is the absence of strength evaluations of its design.

The claimed invention is aimed at creation of a pipeline pump featuring higher strength characteristics, high reliability, and service life due to simultaneous reduction of its vibration load and improvement of sealing combined with minimization of material consumption of its design as a whole.

This technical result is provided by a pipeline pump, comprising support feet, inlet, and outlet pipe adapters; wherein fastening surfaces of the pump support feet coincide with the horizontal plane comprising a common central axis of the inlet and the outlet pipe adapters; also, the pump comprises housing comprising an upper cover and lower base which, when connected, form a horizontal connection plane coinciding with a central axis of a shaft of a rotor which is mounted in bearings secured in supports outside the housing and comprises the end seals; the rotor is mounted on the shaft with neck seals; the cover and the base of the pump housing are provided with flanges where fastening elements are located; the flange of the cover comprises bulges in places of installation of the end seals of the shaft of the rotor; the housing cover comprises reinforcing ribs extending over its outer surface; wherein some of the reinforcing ribs are connected with the bulges of the flange of the cover and the other ribs are connected directly with the flange of the cover; further comprising reinforcing ribs connecting housings of the bearing units of the rotor of the pump with the support feet; wherein the pump housing further comprises reinforcing ribs connecting the support feet with the inlet and the outlet pipe adapters, reinforcing ribs extending under the base of the pump housing and connecting the housings of the bearing units of the shaft of the rotor of the pump to each other, and reinforcing ribs extending under the base of the pump housing and connecting the support feet pair-wise; wherein the cover and the base of the pump housing are provided with internal cavities forming an inlet and an outlet, and all reinforcing ribs are made integral with the cover or the base of the housing. The pump housing and all the aforementioned reinforcing ribs are made integral by casting from carbon or alloyed steels and alloys.

Figure 2:
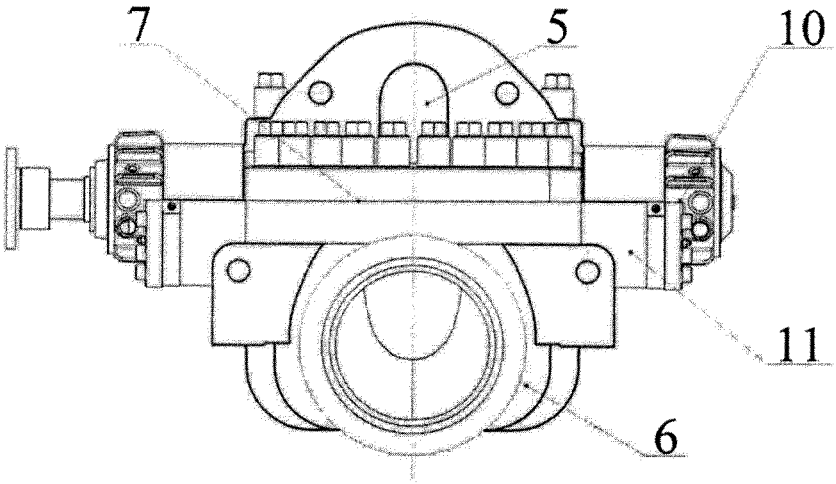
Figure 3:
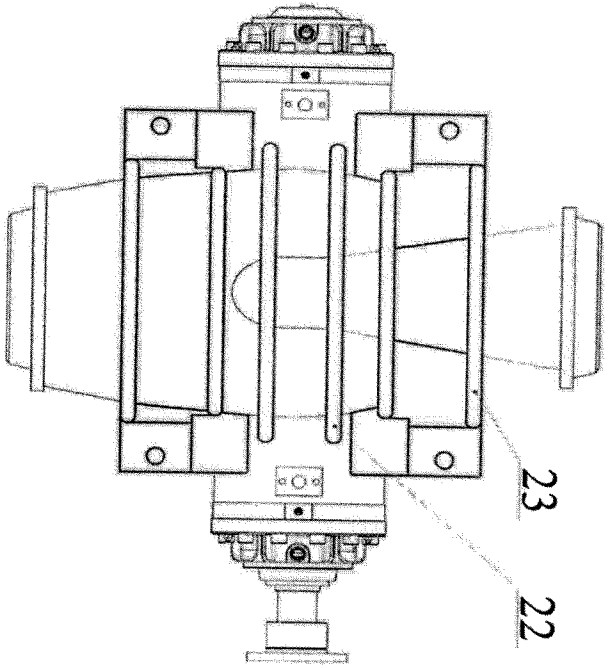
Figure 4:
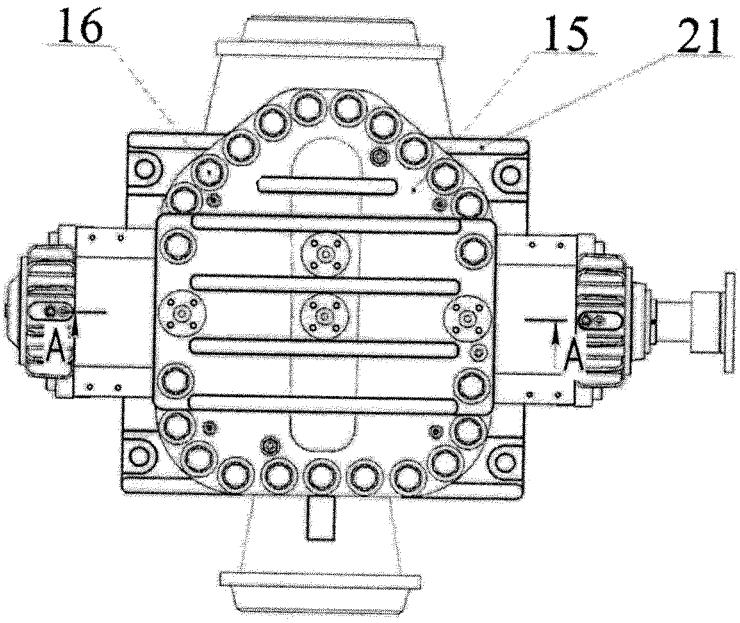
Figure 5:
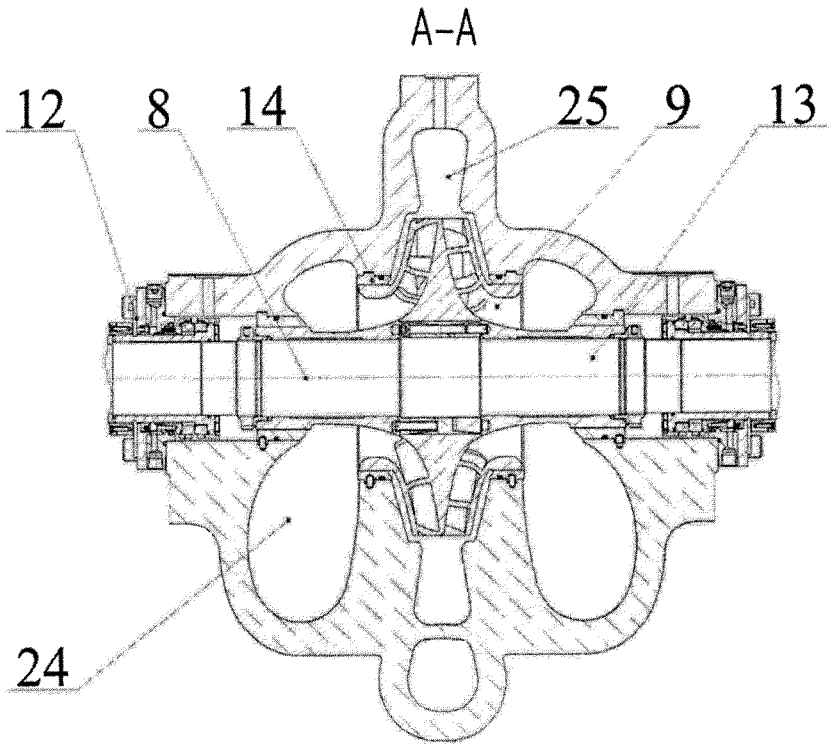

The claimed pipeline pump is illustrated by the drawings, in which FIG. 1 is a general view of the pump, FIG. 2, FIG. 3, and FIG. 4 show different projective views of the pump, and FIG. 5 shows a cross-section A-A of FIG. 4.

As shown in the drawings, the pipeline pump (hereinafter, pump) includes the support feet 1, inlet 2, and outlet 3 pipe adapters. The fastening surfaces of the pump support feet 1 coincide or may be near the horizontal plane comprising the common central axis 4 of the inlet 2 and the outlet 3 pipe adapters making it possible to eliminate the formation of combined tipping torque effect (combined with practically eliminated combined lever length) on the attachments of the feet 1 to the frame (not shown) around the central axes of the inlet 2 and the outlet 3 pipe adapters caused by the pumped liquid flows. Furthermore, the loads on the welds (or flange attachments) of the inlet 2 and the outlet 3 pipe adapters and the pipelines to which they are connected are also eliminated. The pipeline pump has a housing consisting of the upper cover 5 and lower base 6 which, when connected, form the horizontal connection plane 7 coinciding with the central axis 8 of the shaft of the rotor 9 which is mounted in the bearings 10 secured in supports 11 outside the housing and comprises the end seals 12. The rotor 9 is mounted on the shaft 13 with the neck seals 14. The housing cover 5 and base 6 include flanges 15 where the fastening elements 16 are located. The flange 15 of the cover 5 has the bulges 17 in places of installation of the end seals 12 of the shaft 13 of the rotor 9. The housing cover 5 has reinforcing ribs extending over its outer surface; some of these ribs 18 are connected with the bulges 17 of the flange 15 of the cover 5 and the other ribs 19 are connected directly with the flange 15 of the cover 5. As shown, the reinforcing ribs 20 connect the supports 11 of the bearings 10 of the shaft 13 of the rotor 9 with the support feet 1; the reinforcing ribs 21 connect the support feet 1 with the inlet 2 and the outlet 3 pipe adapters; the reinforcing ribs 22 extend under the housing base 6 and connect the supports 11 of the bearings 10 of the shaft 13 of the rotor 9; and the reinforcing ribs 23 extend under the housing base 6 and connect the support feet 1 to each other in pairs. The housing cover 5 and base 6 of the pump 1 contain internal cavities forming an inlet 24 and the outlet 25. All the aforementioned reinforcing ribs 18, 19, 20, 21, 22, and 23 are made integral with the housing cover 5 and base 6 forming a bearing frame of the housing and making it possible to ensure the uniformity of its structure strength, to reduce the movements of separate elements of the pump design relative to each other caused by the high-pressure fluctuations due to high pump shaft rotation speeds, and also to provide tight seal of the flow part of the pump under pressure during its use. Furthermore, the presence of a set of reinforcing elements in the form of the aforementioned reinforcing ribs 18, 19, 20, 21, 22, and 23 connecting the aforementioned pump housing (the cover 5 and the base 6) forming its flow part with the surfaces of the support feet 1, with the supports 11 of the bearings 10 of the shaft 13 of the rotor 9, and with the flanges 15 of the cover 5 and the base 6 solves the problem of reduction and possible minimization of the metal consumption for the pump housing while also providing its increased strength, vibration load, and tight seal, because it makes it possible to considerably reduce the weight of the housing and simultaneously to provide the required rigidity of its structure. All the reinforcing ribs 18, 19, 20, 21, 22, and 23 are made integral with the cover 5 or with the base 6, for example, by casting, for example, from carbon or alloyed steels and alloys. The number of the reinforcing ribs 18 and 19 on the outer surface of the cover 5 is selected depending on the size of the pump housing, the required rigidity of the pump housing, etc. that is, depending on the desired pump characteristics and the operating conditions thereof.

Thus, the claimed invention presented in the combination of features provides a pipeline pump, having increased reliability and service life due to reduction of vibration load and improved sealing combined with decreased consumption of materials and maintained structure strength.

The invention claimed is:

1. A pipeline pump, comprising:

support feet;

wherein the support feet comprise fastening surfaces within a first horizontal plane;

an inlet pipe adapter; an outlet pipe adapter;

wherein the first plane comprises a common central axis of the inlet pipe adapter and the outlet pipe adapter;

a rotor mounted on a shaft with groove seals;

a pump housing comprising an upper cover attached to a lower base:

wherein the upper cover comprises a cover flange; wherein the lower base comprises a base flange; wherein the cover flange and the base flange are connected with fastening elements;

wherein the cover flange and the base flange are connected along a second horizontal plane; wherein the second plane comprises a central axis of the shaft;

wherein the shaft is mounted in bearings installed in supports inside bearing housings; wherein the supports are located on an outer surface of the pump housing;

wherein the shaft is mounted with end seals;

wherein the cover flange comprises bulges in places of installation of the end seals of the shaft of the rotor;

wherein the upper cover comprises first reinforcing ribs extending over an outer surface of the upper cover; wherein at least one of the first reinforcing ribs is connected with the bulges; wherein at least one of the first reinforcing ribs is connected with the cover flange;

second reinforcing ribs connecting bearing housings with the support feet;

wherein the pump housing further comprises: third reinforcing ribs connecting the support feet with the inlet pipe adapter and the outlet pipe adapter, fourth reinforcing ribs extending under the lower base and connecting the bearing housings to each other, and fifth reinforcing ribs extending under the lower base and connecting the support feet pair-wise;

wherein the upper cover comprises first internal cavities; wherein the lower base comprises second internal cavities; wherein the first internal cavities and the second internal cavities form a pump inlet and a pump outlet;

and wherein the first reinforcing ribs, the second reinforcing ribs, the third reinforcing ribs, the fourth reinforcing ribs, and the fifth reinforcing ribs are made integral with the upper cover or the lower base.

2. The pipeline pump of claim 1, wherein the pump housing, the first reinforcing ribs, the second reinforcing ribs, the third reinforcing ribs, the fourth reinforcing ribs, and the fifth reinforcing ribs are made integral by casting from carbon or alloyed steels and alloys.

* * * * *